US008506430B2

(12) United States Patent
Von Der Gruen et al.

(10) Patent No.: US 8,506,430 B2
(45) Date of Patent: Aug. 13, 2013

(54) OVAL BALL, ESPECIALLY RUGBY BALL OR FOOTBALL

(75) Inventors: Thomas Von Der Gruen, Kleinsendelbach (DE); Norbert Franke, Erlangen (DE); Reiner Retkowski, Erlangen (DE)

(73) Assignee: Fraunhofer—Gesellschaft zur Foerderung der Angewandten Forschung E.V., Munich (DE)

( * ) Notice: Subject to any disclaimer, the term of this patent is extended or adjusted under 35 U.S.C. 154(b) by 419 days.

(21) Appl. No.: 12/582,993

(22) Filed: Oct. 21, 2009

(65) Prior Publication Data

US 2010/0130314 A1 May 27, 2010

Related U.S. Application Data

(60) Provisional application No. 61/161,463, filed on Mar. 19, 2009.

(30) Foreign Application Priority Data

Oct. 22, 2008 (DE) ..... 10 2008 052 621

(51) Int. Cl.
*A63B 41/00* (2006.01)

(52) U.S. Cl.
USPC ..... 473/570; 473/599

(58) Field of Classification Search
USPC ..... 473/570, 599, 605, 594
See application file for complete search history.

(56) References Cited

U.S. PATENT DOCUMENTS

| | | | | |
|---|---|---|---|---|
| 4,923,196 | A * | 5/1990 | Rohring | 473/570 |
| 5,779,576 | A * | 7/1998 | Smith et al. | 473/570 |
| 6,157,898 | A * | 12/2000 | Marinelli | 702/141 |
| 6,251,035 | B1 | 6/2001 | Fa | |
| 2006/0180647 | A1 * | 8/2006 | Hansen | 235/375 |
| 2008/0274844 | A1 * | 11/2008 | Ward | 473/570 |

* cited by examiner

*Primary Examiner* — Arthur O. Hall
*Assistant Examiner* — Allen Chan
(74) *Attorney, Agent, or Firm* — Marshall & Melhorn, LLC

(57) ABSTRACT

An oval ball, in particular rugby ball or football with a casing and with at least one electronic component or module with a transmitter unit, which is arranged in the casing and is held in a defined position, wherein the at least one electronic module is fastened on or in a shape part with a positive and/or material fit, in the region of the tips or in the region of a valve of the casing. In a further embodiment, the module is suspended on nets which are connected to the tip region of the casing in a large-surfaced manner.

10 Claims, 3 Drawing Sheets

OVAL BALL, ESPECIALLY RUGBY BALL OR FOOTBALL

Figure 1:
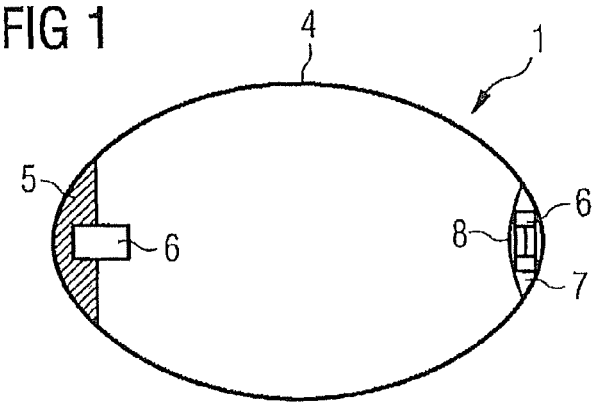

The invention relates to an oval ball, in particular rugby ball or football.

Oval or egg-shaped balls or ones designed as an elongated spheroid or ellipsoid of revolution are used for a game of rugby or a game of "American football", and these usually comprise an inflatable bladder and a carcass surrounding the bladder. In recent times, one has aspired to be able to follow the ball during a game, in order to achieve an improved recording of the game, but also to achieve possibilities for decision making in certain situations. For this, the ball must be provided with a transmitter, which transmits signals to receivers arranged in the region of the playing field or at the edge of the playing field.

An oval ball with light and sound effects is known from U.S. Pat. No. 6,251,035, with which a light-producing element and/or noise-producing element is arranged within the oval ball. Thereby, the light element is arranged in the middle of a strip which is fastened at the thin ends of the bladder of the ball.

Proceeding from this state of the art, it is the object of the invention to arrange an electronic component or module within a casing of an oval ball, wherein the electronic component is held in a defined position in a secure manner and wherein the forces acting on the component during the game are to be kept low and the dynamic characteristics of a ball provided with an electronic component are not to be negatively influenced.

According to the invention, this object is achieved by the characterising features of the main claim in combination with the features of the preamble.

Further advantageous designs and improvements are possible by way of the measures specified in the dependent claims.

By way of the fact that the electronics module comprising a transmitter unit is fastened with a positive and/or material fit on or in a shape part in the region of the tips or in the region of the valve of the ball, the electronic component or the module is subjected to less strong forces, since the shape part accommodates the loads with the use of the ball. The accommodation at the tips is advantageous, since the ball is usually hit at the long sides. Thereby, "region of the tips" is to include the two ends of the oval ball, but in the case of an elliptical cross section of the ball, also include the region which includes a focal point. The accommodation of the module in the region of the valve is likewise advantageous, since a reinforcement is provided as a base for the valve which supports the electronic module. The shape part may comprise cavities or be designed in a honeycomb-like manner, in order to reduce its weight.

In one embodiment example, the electronic module in the middle region of the ball is fastened in a freely suspended manner on at least two net parts provided with meshes, said net parts in each case being connected to the casing in a large-surfaced manner and with a material fit, in each case in the regions of the tip of the ball.

Advantageously, the at least one electronic component or module is fastened with a positive fit and, as the case may be, with a material fit, directly in the tip or the oval end, and it is particularly advantageous if in each case an electronic component or module with the transmitter unit is arranged at both tips or both ends of the oval, since in this case one may also be able to determine the orientation of the ball on account of the transmitted signals.

In an advantageous embodiment example, the component or module is applied into a lug which is integrally formed in the region of the tip of the casing and which forms the shape part, i.e. the casing is provided with a reinforcement with an embossing, into which the electronic component or module is inserted with a positive fit. The position of the electronic component or the module in the casing is defined by way of this. Additionally, a lug with embossing or receiver space and the component or module may be bonded to one another.

The casing may also be provided with a chamber in the region of the tip or in the oval region, into which chamber the component or module may be inserted, in order to keep the weight of the additional receiver element or shape part for the electronic component or module in the casing low. Thereby, the chamber may be formed by way of an additional integrally formed elastic or non-elastic flexible covering, which covers the component or the module and which may be bonded to the casing or may be connected to the casing with connection elements.

The casing of the ball may have only one carcass-like outer casing, but it may also consist of the carcass-like outer casing and a bladder inserted therein. In the case that the ball consists of an outer casing and a bladder, the at least one electronic component or module may be connected to the outer casing or to the bladder.

The electronic component or module or the components or modules may comprise transmission units with at least one antenna element and/or sensors for detecting ball parameters, but also a microcontroller, wherein the antenna element or elements may be provided directly on the transmitter or also separately from it. In the later case, it may be fastened on the casing, the shape parts or net parts and be connected to the transmitter by way of electrical leads.

Advantageously, the electronic component or the module may be designed as an electronic module essentially in a two-dimensional manner and be firmly connected to the casing in the tip region or the valve region (base). Since it is integrated into the ball or the casing in a flat manner, the dynamic characteristics of the ball are hardly influenced.

The electronic component or the module may comprise a chargeable battery, wherein it contains a suitable charging circuit, and a charging loop for the contactless inductive charging is assigned to it. Thereby the charging loop may for example be bonded into the tip or may be arranged opposite a valve which is used for inflating the casing. It may be integrated in the net parts or also be fastened on or in the shape part.

A programming loop may be provided in a similar manner as the charging loop, via which programming loop the electronics module or the charging circuit or the microcomputer may likewise be inductively programmed. The charging loop and the programming loop may be grouped together into a loop which carries out both functions.

It is particularly advantageous if two electronic components or modules are provided in the tip regions, which compensate one another, so that the ball becomes balanced.

If in each case an electronics module comprising a transmitter is arranged in the two tip regions, they may advantageously be used for localising and detecting the alignment of the ball in a suitable tracking system.

Figure 2:
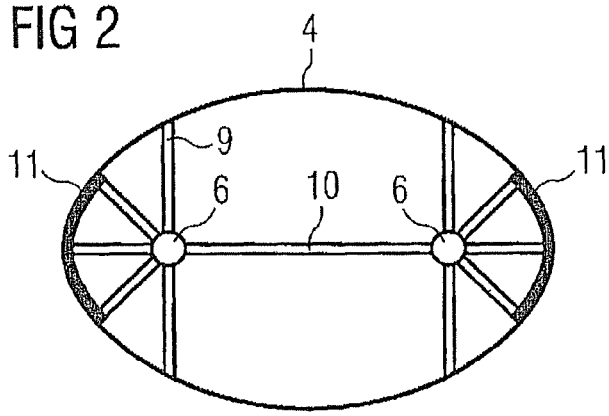
Figure 3:
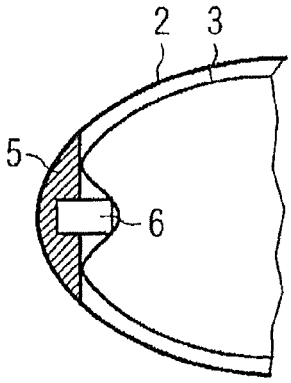
Figure 4:
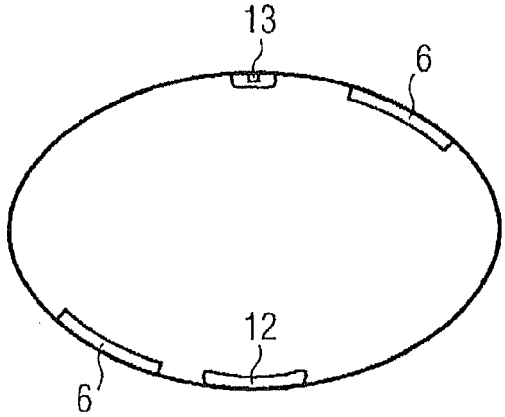
Figure 5:
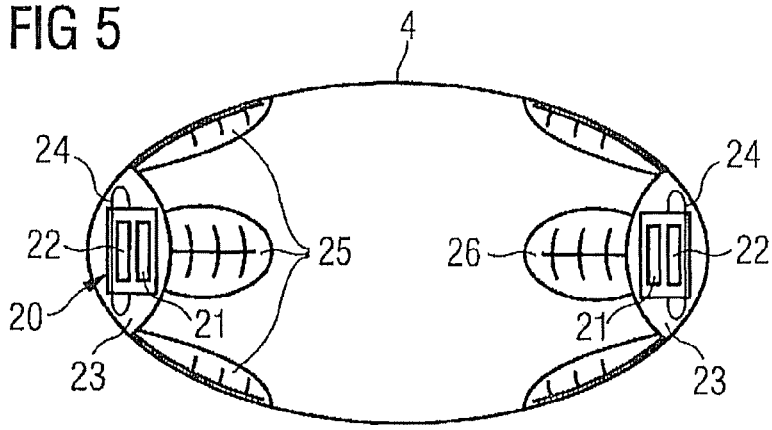
Figure 6A:
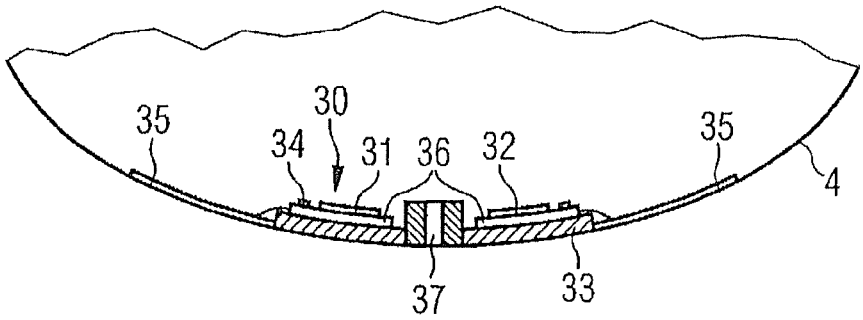
Figure 6B:
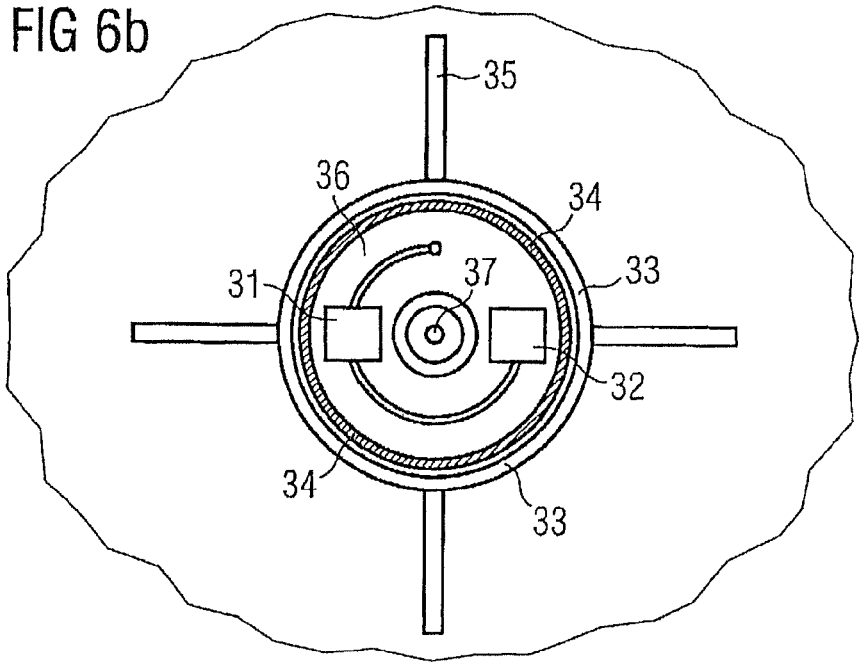

Embodiment examples of the invention are represented in the drawing and there are explained in more detail in the subsequent description. There are shown in:

FIG. 1 a schematic section through a ball according to the invention, according to a first and second embodiment example, FIG. 2 a schematic section through a ball according to a third embodiment example, FIG. 3 a part section through a ball analogously to the first embodiment example, and FIG. 4 a schematic section through a ball according to a fourth embodiment example, FIG. 5 a schematic view of a ball according to the invention, with which the arrangement of the electronic module is designed is a somewhat more accurate manner, and an electronic module or component are provided in each case in both tips according to the first or second embodiment example, FIG. 6 a sectioned view of a fifth embodiment example, with which the electronic module or component is arranged on the base of the valve (FIG. 6*a*) and a plan view of this (FIG. 6*b*), FIG. 7 a view, in section, of a sixth embodiment example, with which the electronics module is suspended on nets in the inside of the ball.

A rugby ball or football, i.e. a ball with an oval shape, is represented in FIG. 1, wherein balls mainly consist of a carcass-like outer casing 2 and of an inflatable bladder 3 (see FIG. 3). The ball 1 with the casing 4 in the embodiment example comprises an electronics module 4, wherein two different possibilities of the receiving are shown in FIG. 1. The casing 4 in FIG. 1 on the left side is provided with a lug 5 or reinforcement as a shape part, which has a recess or a cavity for the positionally correct receiving of an electronics module 6. This may also be recognised in FIG. 3. The electronics module 6 thereby may be clipped in with a positive fit, wherein locking connections may also be provided, which firmly hold and engage behind the electronics module. Another possibility is to bond the electronics module 6 into the lug 5 or the reinforcement.

Another possibility for accommodating an electronics module 6 in the casing 4 is represented in FIG. 1 on the right, wherein here a chamber 7 is formed in the casing, and this chamber is closed off by an additional skin or a fabric as a covering, which is applied over the electronics module and connected to the casing, e.g. by way of bonding. Additionally, as already mentioned, the casing 4 may thereby be the carcass-like outer casing 2 or also the bladder 3. As a whole, in this embodiment example according to FIG. 1, the end-pieces of the bladder or of the carcass may be designed in a stable manner or solid or elastic plastic parts as shape parts may be bonded to the carcass or to the bladder.

In the embodiment examples of the ball with the carcass and the bladder, the bladder in the pumped-up condition presses against the shape part or parts or against the electronics module, so that one ensures a further stability by way of this.

One may achieve particularly stable mechanisms if one uses seams of the ball carcass which lie on the inside.

Of course, for the arrangement according to FIG. 1, on the left side, one may additionally provide a flexible element engaging over this arrangement, similarly to the closure of the chamber 7, which is bonded to the casing 4.

In another embodiment example, the electronic component or module 6 may be bonded directly to the casing 4 in the respective oval end regions.

A carcass-like outer casing 2 with an inner-lying bladder 3 is shown in FIG. 3, wherein the electronics module 6 as in FIG. 1, is accommodated in the reinforcement 5 or the lug with a positive-fit. It is shown in this figure that the bladder 3 itself contributes to pressing the electronics module 6 against the reinforcement 5.

In FIG. 2, two electronics modules 6 are suspended on strips 9, which are connected to the casing 4, wherein the strip 10 which runs between the two tips which may likewise be provided with a reinforcement 11, are designed in a reinforced manner. In the shown embodiment example, the two electronics modules 6 are arranged roughly in the respective focal point of the ellipse, which is formed by a longitudinal section through the ball. The anchor points of the strips 9, which may be designed in an elastic or flexible manner, may be reinforced for example by way of adhesive points.

FIG. 4 shows a further example, with which the respective electronics module 6 is designed as a two-dimensional formation on a preferably flexible strip conductor film, which is integrated into the casing 4 in a flat manner, for example by way of bonding to this. Moreover, a charging loop 12 is shown in FIG. 4 in a schematic manner, which is connected to a charging circuit which is not shown and which for example is arranged opposite a ball which is imbalanced due to a valve 13, so that the ball becomes balanced. As the case may be, the charging loop may be accommodated in one of the tips of the ball.

As will be described later (FIG. 6), an accommodation of the two-dimensional electronics module 6 on the base of the valve is possible.

In the above and in following embodiment examples, a programming loop may be provided additionally to or in place of a charging loop or also be provided in a loop as a function unit, by way of which the electronics module 6 may be programmed via inductive coupling. In this manner, the caging and programming station for the module may be designed as a ball stand common in rugby, which holds the ball upright and serves for being able to kick the ball away.

In one embodiment example which is not represented, chambered bladders may be considered, wherein air-permeable connections may exist between chambers, in order to ensure a pressure compensation. Moreover, an embodiment form which is not represented may envisage the provision of several, e.g. four bladder elements. The electronics module is then fastened on the inner surfaces, wherein as the case may be, suitable mechanical structures are deposited onto the bladder surfaces.

The weight arising due to the electronics module and the suspension may be taken into account for a balancing in the ball at a suitable location by way of an additional or balancing weight, but if a defined weight of the ball is stipulated, the additional weight created by way of the electronics module and the suspension, as the case may be, must be compensated by way of saving of weight at another location of the ball.

The electronics module 6 may be designed such that it is not formed as one part, but function units may for example be separated in different components or modules. E.g. electronics and the battery may be separated, in order to be able to better distribute two smaller masses with this. In this case, in each case one component or module would be arranged in the respective tips. Moreover, antenna structures may be designed in a flat manner and be deposited onto the casing starting from the tips. As the case may be, better radiation characteristics may be achieved with such much larger antennae.

The integrated electronics module may be developed and used for the most different of functionalities, for example a module in the ball may serve for the localisation of the ball, whilst two electronics modules with suitable transmitting characteristics may be used for localisation and additionally for obtaining information on the alignment or orientation of the ball. Finally, one may provide a module for sensor data, such as ball air pressure, acceleration temperature, etc.

One example of the arrangement according to FIG. 1 is represented in somewhat more detail in FIG. 5. The electronics module 20 which may correspond to the electronics module 6 of the preceding example and which comprises a transmitter unit 21 and a battery 22 with a suitable charging circuit, which are arranged on a circuit carrier, is applied into a shape part 23. The module itself is relatively light, i.e. it is a few tens of a gram. The shape part 23 next to the space for receiving the module 20 is provided with further cavities, in order to save weight and to form an "impact zone". For example, the shape part 23, which is preferably manufactured of an elastic or bendable plastic, has a honeycomb structure. Before or after the insertion of the module, it is connected to the casing 4 of the ball 1 in the region of its tips, for example by way of binding, or locking connections and clip connections, wherein its outer shape or the housing of the module may be adapted to the shape part 23. The shape part 23 itself may also simultaneously be the housing, so that the shape part together with the transmitter may be inserted into the casing.

A charging loop or programming loop 24, which, as described above serves for charging the battery 22 and as the case may be for programming, is also inserted into the shape part. The loop 24 may be incorporated into the shape part at the time of its manufacture or be guided at the outside on the shape part. Typical dimensions of the loop are 3 to 5 cm diameter and it usually has several twists. These may be designed for example as cords. Moreover, antenna elements 25 connected to the transmitter 21 as four dipole paddle antenna, e.g. for 2.4 GHz, are provided, which by way of the shape part 23 are fastened on one side and are freely movable with the remaining part, so that, as the case may be, they may slide on the inner surface of the casing 4 and compensate deformations of this. For example, the antenna elements may be manufactured of a flexible circuit board piece which is flexibly connected to the shape part 23.

In the embodiment example according to FIG. 5, electronic modules 20 are arranged in an axially symmetrical manner in both tips of the ball 1, so that with the information of the two transmitters 21, one may also determine the orientation of the main axis additionally to localising the ball 1. However, one may also provide only one electronics module 10 in the one tip and a counter-weight in the other tip.

A further embodiment example of the ball 1 with an electronics module 30 which may have the components already described above is represented in FIG. 6. In this case, the electronics module 30, with an annular, as the case may be, flexible circuit board 36 and a flat location transmitter 31 arranged thereon and a battery 32, may be fastened on a shape part, said shape part here being the base 33 of a valve 37 for inflating the casing 4. Here too, an annular lead and/or loop 34 is provided, which as a strip conductor may be deposited on the circuit board 36 or in a wire-like or strip-like manner on the base 33. Dipole antenna elements 35 are fastened on one side onto the base 33 and are otherwise freely movable, similarly to the preceding embodiment example. The schematic view of the region around the valve 37 is represented in section in FIG. 6*a,* whilst the plan view is shown in FIG. 6*b.*

One embodiment example is represented in FIG. 7, with which the electronics module 40 is arranged in the operating condition of the ball 1, i.e. is arranged in its nominal shape in its middle. The electronics module 40 here is held by two nets or net parts 41, 42 for example of plastic such as polymeric plastic, for example aromatic polyamides, which is provided with meshes as is indicated in the figure by way of the cross-hatching. The respective net part 41, 42 is connected to the casing 4 in a surfaced manner in the region of the tip of the ball 1. In the embodiment example, the ball consists of the carcass 2 and of the bladder 3 and in each case a further layer 43 of the material of the bladder 3 which is connected to the bladder, is provided in the fastening regions of the net parts 41, 42, wherein the respective net part 41, 42 is fixed between the further layer 43 and the bladder 3 in the tip region of the ball 1. The connection of the two layers 43 and 3 is effected by way of bonding, laminating, welding, vulcanising or likewise.

Figure 7A:
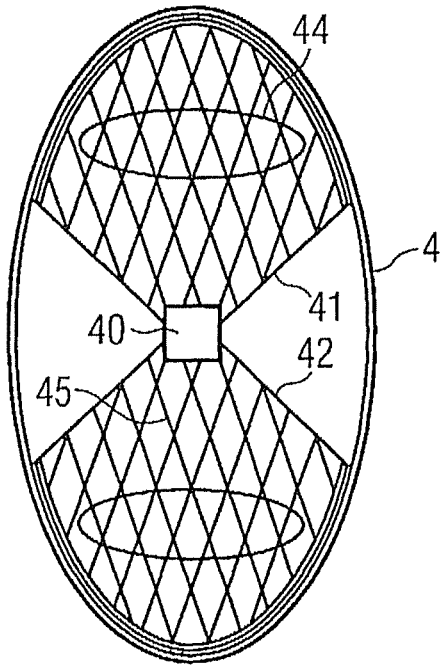
Figure 7B:
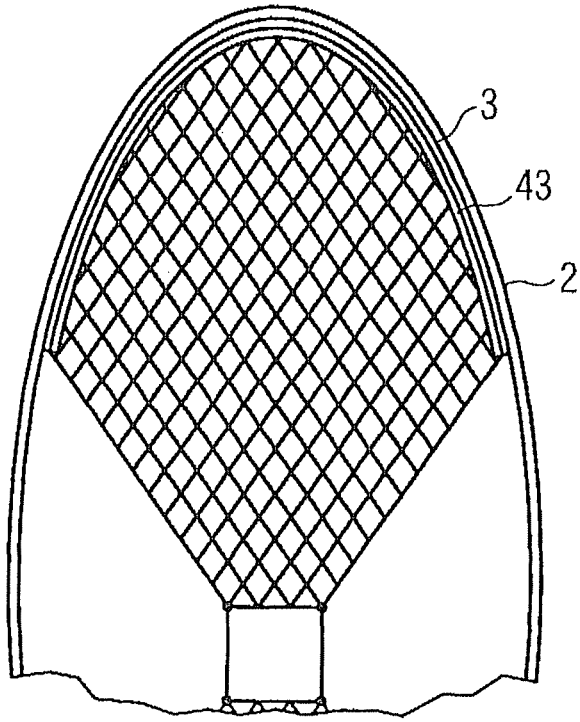

The electronics module 40 is then fastened to the free non-fastened regions of the net parts 41, 42 such that when the bladder 3 is inflated into its operating condition, the module 30 is arranged in the middle of the ball. For this, the net parts 41, 42 are dimensioned such that they meet roughly in the middle in the tensioned condition. This may be recognised in the figure, whereby FIG. 7*a* shows the whole ball, whilst FIG. 7*b* is a somewhat enlarged detail. In one embodiment, the housing of the electronics module may be manufactured of a composite material which also includes the net. Then, an electronics module with nets may be manufactured, which were then connected to the bladder in the described manner. Another possibility is to manufacture the nets in each case with a housing half, which are then welded to one another, for example by way of ultrasound.

If the electronics module 40 comprises a battery and/or microcomputer, at least one charging loop and/or programming loop 44, in the present case two, are provided, which are woven into the meshes or are threaded into the meshes. Necessary electrical connection leads 45 or HF-cords are likewise worked into the meshes. The same applies to the antenna elements.

The material of the net parts or their elasticity characteristics are selected such that the module 40 remains securely in the middle of the ball whilst compensating the movement of the ball.

Different embodiment examples are explained by way of different features as the case may be, in the above description. Even if they were to be applicable to other ones, they have not been repeated for each example. For this reason, the description of individual features with regard to one embodiment example should not represent a limitation of the feature only to this embodiment example.

The invention claimed is:

1. An oval ball, in particular rugby ball or football, comprising a casing and at least one electronic module which is arranged within the casing and is flexibly held at a predefined position, said electronic module comprising at least one transmitter, wherein the electronic module is flexibly fastened in a freely suspended manner in the middle region of the ball on at least two separate nets or at least two parts of a single net which are provided with meshes and wherein a significant portion of each net or part of the net is attached to the casing, in each case in the regions of the tips of the ball; and at least one of electrical leads, at least one charging loop for a battery or at least one antenna element is integrated into the at least two nets or at least two parts of the net.

2. A ball according to claim 1, wherein a shape part or the net parts are bonded, laminated in, welded or vulcanised, in the region of the tip or the tips.

3. A ball according to claim 1, wherein the casing comprises at least one of a carcass-like outer casing and a bladder.

4. A ball according to claim 3, wherein the net parts are laminated-in in the region of the tips between the bladder and a layer.

5. A ball according to claim 1 or claim 4, wherein the net parts are firmly connected in each case to a housing part of the electronics module.

6. A ball according to claim 1, wherein the electronic module is an electronics module which is equipped with sensors for detecting ball parameters.

7. A ball according to claim 4, wherein a programming loop for contactless inductive programming is assigned to the electronic module.

8. A ball according to claim 4, wherein the layer is of the material of the bladder.

9. A ball according to claim 1, wherein the antenna element is woven into the net parts.

10. A ball according to claim 7, wherein the programming loop is also a charging loop.

* * * * *